US009376954B2

(12) United States Patent
Noll et al.

(10) Patent No.: US 9,376,954 B2
(45) Date of Patent: Jun. 28, 2016

(54) CONSTRUCTION MACHINE WITH AUTOMATIC FAN ROTATIONAL SPEED REGULATION

(75) Inventors: Tobias Noll, Roschbach (DE); Ralf Weiser, Ladenburg (DE); Thomas Riedl, Mannheim (DE)

(73) Assignee: JOSEPH VOGELE AG, Ludwigshafen/Rhein (DE)

( * ) Notice: Subject to any disclaimer, the term of this patent is extended or adjusted under 35 U.S.C. 154(b) by 0 days.

(21) Appl. No.: 13/482,034

(22) Filed: May 29, 2012

(65) Prior Publication Data

US 2012/0305232 A1 Dec. 6, 2012

(30) Foreign Application Priority Data

Jun. 1, 2011 (EP) ..... 11004512

(51) Int. Cl.
*B60K 11/06* (2006.01)
*F01P 7/04* (2006.01)

(52) U.S. Cl.
CPC ..... *F01P 7/042* (2013.01)

(58) Field of Classification Search
CPC ... F01P 7/042; F01P 2023/08; F01P 2025/62; B60K 11/06; G05D 23/00
USPC ..... 123/41.12, 41.11; 192/85.02, 85.2
See application file for complete search history.

(56) References Cited

U.S. PATENT DOCUMENTS 4,124,001 A * 11/1978 Samuel et al. ..... 123/41.12
4,292,813 A * 10/1981 Paddock ..... F25B 49/02 165/269
4,425,766 A 1/1984 Claypole
4,467,901 A * 8/1984 Hattori et al. ..... 192/58.63
4,557,223 A 12/1985 N'Gueyen
4,580,531 A 4/1986 N'Gueyen
4,691,668 A 9/1987 West
4,765,284 A 8/1988 Kanazawa et al.
4,798,177 A * 1/1989 Oomura ..... F01P 7/044 123/41.02
4,920,929 A * 5/1990 Bishop ..... 123/41.49
5,228,300 A * 7/1993 Shim ..... F25D 21/006 62/131
5,507,251 A * 4/1996 Hollis ..... F01P 7/167 123/41.1
5,609,125 A 3/1997 Ninomiya
5,657,722 A * 8/1997 Hollis ..... F01P 7/167 123/41.08

(Continued)

FOREIGN PATENT DOCUMENTS

CN 101936211 A 12/2010
JP 08177887 A 7/1996

(Continued)

OTHER PUBLICATIONS

European Search Report dated Nov. 4, 2011, which issued in corresponding European Application No. EP11004512.

(Continued)

*Primary Examiner* — Brodie Follman
*Assistant Examiner* — Brian Cassidy
(74) *Attorney, Agent, or Firm* — Fish & Richardson P.C.

(57) ABSTRACT

The present invention describes a construction machine with a drive unit and with a cooling system that comprises a fan. The fan is connected to the drive unit by means of a controllable viscous coupling, whereby the viscous coupling can be adjusted in such a way that a required fan rotational speed is set on the output side. The invention furthermore describes a method for the automatic fan rotational speed regulation for a cooling system in a construction machine.

12 Claims, 5 Drawing Sheets

(56) References Cited

U.S. PATENT DOCUMENTS 5,658,140 A * 8/1997 Kondou ..... F23N 3/082 431/31
5,732,676 A * 3/1998 Weisman ..... B60K 31/04 123/436
5,855,266 A * 1/1999 Cummings, III ..... 192/58.42
5,947,189 A 9/1999 Takeuchi et al.
5,947,247 A * 9/1999 Cummings, III ..... 192/70.12
6,079,536 A * 6/2000 Hummel ..... F01P 7/026 192/103 R
6,101,987 A 8/2000 Saur et al.
6,213,061 B1 4/2001 Bartolazzi et al.
6,340,006 B1 1/2002 Malatto et al.
6,346,789 B1 2/2002 Bird et al.
6,377,880 B1 * 4/2002 Kato ..... B60K 6/485 180/65.26
6,453,853 B1 * 9/2002 Hawkins et al. ..... 123/41.12
6,470,838 B2 10/2002 Ap et al.
6,648,115 B2 * 11/2003 Smith ..... F16D 37/00 192/21.5
6,880,497 B1 * 4/2005 Avery, Jr. ..... F01P 7/048 123/41.12
7,011,050 B2 3/2006 Suda et al.
7,047,911 B2 * 5/2006 Robb et al. ..... 123/41.12
7,058,477 B1 * 6/2006 Rosen ..... G05D 23/1931 236/1 C
7,066,114 B1 6/2006 Hannesen et al.
7,134,406 B1 * 11/2006 Loes ..... 123/41.11
7,165,514 B2 * 1/2007 Bowman et al. ..... 123/41.12
7,249,664 B2 * 7/2007 Ignatovich et al. ..... 192/85.02
7,341,026 B2 * 3/2008 Laukemann ..... 123/41.12
7,387,591 B2 * 6/2008 Shiozaki ..... 477/167
7,397,354 B1 7/2008 Easton
7,407,046 B2 * 8/2008 Bhat ..... F16D 35/024 192/58.61
7,421,984 B2 9/2008 Braun et al.
7,455,239 B2 11/2008 Braun et al.
7,484,378 B2 * 2/2009 Allen ..... F01P 3/18 62/158
7,516,827 B2 * 4/2009 Pickelman, Jr. ..... 192/85.24
7,863,839 B2 * 1/2011 Schuricht ..... F01P 7/044 123/41.12
8,015,954 B2 9/2011 Kardos
8,118,148 B2 * 2/2012 Shiozaki ..... F01P 7/042 192/58.61
8,196,553 B2 6/2012 Kline et al.
8,241,008 B2 * 8/2012 Tsai ..... F04D 27/00 417/22
8,567,356 B2 * 10/2013 Jacobsson ..... F01P 7/04 123/41.08
8,616,160 B2 12/2013 Suzuki
8,632,314 B2 * 1/2014 Imaizumi ..... F01P 7/044 123/41.12
8,868,250 B2 * 10/2014 Jensen ..... G05B 11/16 361/676
2001/0025610 A1 10/2001 Weber
2002/0066422 A1 6/2002 Hawkins et al.
2003/0041814 A1 3/2003 Laird et al.
2005/0081801 A1 4/2005 Braun et al.
2008/0238607 A1 * 10/2008 Schuricht ..... F01P 7/044 340/3.1
2009/0025997 A1 * 1/2009 Ishii ..... A01D 69/03 180/242
2009/0155045 A1 6/2009 Chang et al.
2010/0215510 A1 * 8/2010 Tsai ..... F04D 27/00 417/32
2010/0326067 A1 12/2010 Weiser et al.
2010/0332875 A1 * 12/2010 Singh ..... F04D 27/004 713/322
2011/0120426 A1 5/2011 Back et al.
2011/0214627 A1 * 9/2011 Nishikawa ..... F01P 7/04 123/41.02

FOREIGN PATENT DOCUMENTS

JP 2001-182535 A 7/2001
JP 2002098245 A 4/2002
JP 2001-200796 A 1/2003
JP 2004068640 A 3/2004
JP 2005214155 A 8/2005
JP 2006105025 A 4/2006
JP 2005-121028 A 11/2006
JP 2007321622 A 12/2007
WO 2005121588 A1 12/2005
WO 2007119318 A1 10/2007

OTHER PUBLICATIONS

Office Action which issued on Mar. 11, 2014 in corresponding Chinese Application No. 201210180558.3, with English translation thereof.
Office action which issued Feb. 16, 2015 in corresponding Chinese Application No. 201210180558.3, and English translation thereof.
Office Action which issued on Aug. 25, 2015 in corresponding Japanese Application No. 2012-123421, with English translation thereof.
Office Action which issued on Jan. 26, 2016 in corresponding Japanese Application No. 2012-222755, with English translation thereof.
Office Action which issued on Feb. 12, 2016 in corresponding U.S. Appl. No. 13/647,587.

* cited by examiner

CONSTRUCTION MACHINE WITH AUTOMATIC FAN ROTATIONAL SPEED REGULATION

BACKGROUND OF THE INVENTION

The present invention relates to a construction machine with automatic fan rotational speed regulation and to a method for driving a fan.

In construction machines, particularly road pavers and feeders, diesel engines are used as drive motors. Both the diesel engines and the units driven by them have waste heat, conditional on their degree of efficiency, that must be dissipated by means of coolers. In current road pavers, cooling to the required temperatures is brought about via heat exchangers by means of various cooling media, such as cooling water, charge air and/or hydraulic oil, for example. In order to ensure an airflow through the heat exchangers, a fan is an element of the cooling system. It is known to connect the fan rigidly to the diesel engine, so that the fan at all times takes on a fan rotational speed that corresponds to the output rotational speed of the diesel engine.

Also known is the use of a cooling air supply as needed that can be achieved in practice with a hydraulically driven fan in the case of road pavers. This has the disadvantage, however, that hydraulic losses in the fan drive must be accepted. The financial expenditure likewise increases enormously if the degree of efficiency of a hydraulic fan drive is to be optimized. This is because an optimization of the degree of efficiency of the hydraulic fan drive means that it is no longer possible to make use of economical constant flow pumps.

OBJECTS OF THE INVENTION

An object of the present invention is a construction machine with automatic fan rotational speed regulation by means of which a cooling airflow automatically adjusts to different operating conditions of the construction machine, whereby economical and low-noise technical means are used for this purpose. It is likewise the object of the invention to create a method for automatic regulation of a cooling airflow.

SUMMARY OF THE INVENTION

In a preferred embodiment of the present invention the construction machine is a road paver or a feeder. The construction machine comprises a drive unit and a cooling system with a fan that is provided in order to generate a cooling airflow. According to the invention, the cooling system furthermore comprises a controllable-viscous coupling that is connected on the input side to the drive unit and on the output side to the fan of the cooling system. The viscous coupling transmits a driving torque of the drive unit to the fan located on the output side, so that this fan generates a cooling airflow.

In the case of the invention, controllable viscous couplings offer the possibility of transmitting different torques by means of different oil levels within the coupling. The viscous coupling consists of two discs arranged opposite each other, whereby one disc forms the drive unit and the second disc represents the output side. If torques are to be transmitted, the coupling space must be filled with oil so that the output side is moved along with the input side due to the dynamic viscosity of the oil. Because of the function, the rotational speed on the output side of a viscous coupling will always be lower than the rotational speed on the input side. If lower output rotational speeds are to be realized, this can be implemented by a lower oil level. By means of permanent oil circulation within the viscous coupling, which does not start until certain minimum rotational speeds, the oil level of the coupling can be regulated with the help of an oil-feeding valve and a constant oil-draining flow. If there is a requirement for a low rotational speed on the output side of the viscous coupling, the oil control valve is closed and the oil still present in the coupling is displaced out of the oil space through an oil outlet bore hole by means of centrifugal forces. If there is no oil in the viscous coupling, a minimum rotational speed, namely a slip rotational speed, is established. If the target rotational speed on the output side is raised, more oil must be fed through the oil control valve than can drain away through the oil outlet, as a result of which there is an increase in the rotational speed. If the viscous coupling is completely flooded with oil, the upstream rotational speed regulation needs a long length of time until the output rotational speed reaches the target rotational speed. The lower the drive rotational speed, the longer this length of time is. Particularly when idling, the internal oil circulation of the viscous coupling is greatly reduced, so that rotational speed regulation is impossible at this operating point.

In the case of the invention, the controllable viscous coupling ensures a low-noise connection between the actuator unit and the fan. This improves the working conditions for the personnel who are close to the construction machine and simplifies their communication with one another.

The controllable viscous coupling makes possible situation-dependent activation of the fan, whereby a required rotational speed can be adjusted for the fan depending on the oil level in the viscous coupling and whereby this rotational speed can be independent of the rotational speed of the drive unit. It is also advantageous that in the case of the invention, the viscous coupling can minimize or completely prevent a torque transmission between the drive unit and the fan, so that the fan moves at a minimum rotational speed or stops. This is particularly useful in order to reach optimal operating temperatures as quickly as possible when starting the construction machine at temperatures close to freezing.

The viscous coupling furthermore allows a way to drive the fan that is more fuel-conserving than if the fan were to be connected rigidly to the drive unit. The fan rotational speed that is set up is namely lower than the drive rotational speed of the drive unit, whereby this reduced fan rotational speed is sufficient for a normal motor load.

The viscous coupling likewise has the technical advantage that the waste heat is less than that with a hydraulic drive of the fan, as a result of which an improved total degree of efficiency results due to the viscous coupling.

In addition to this, the viscous coupling can be adjusted so that torques of the drive unit can be transmitted to the fan in a gentle manner, meaning softly and not abruptly. As a result, proper function of the fan is preserved for the construction machine for a longer period of time.

The cooling system preferably comprises a controller that is connected to the viscous coupling and/or to the drive unit. A particular oil level can be adjusted in the viscous coupling by the controller. Depending on the oil level, it is possible to convert the drive torque into a particular output torque by means of the viscous coupling.

The viscous coupling can be adjusted by the controller in such a way that a certain rotational speed or torque ratio arises between the drive unit and the fan.

In a further embodiment of the invention, the controller is formed to register at least one operating temperature of the cooling system. This is preferably an operating temperature of the charge air, hydraulic oil and/or cooling water. In this way, the controller makes it possible to monitor the operating state of the cooling system in real time. In this way, it is furthermore ensured that the controller drives the viscous coupling on time in order to counteract any extreme temperatures of the cooling system that may arise.

In addition to the operating temperatures of the cooling system, it is also possible that the controller is formed to register at least one operating temperature of the drive unit, preferably an intake and/or an ambient temperature. This offers the advantage that the controller, particularly in summer, when extreme temperatures arise in the vicinity of the construction machine due to the heat additionally generated by the newly laid pavement, likewise includes the ambient conditions for the fan rotational speed regulation.

It is also useful if the controller is constructed to register a lower and/or upper limiting temperature of the respective operating temperatures of the cooling system and/or of the drive unit, so that the controller can react quickly to overheating and/or undercooling of the operating temperatures.

In a further embodiment, the controller is constructed to regulate the viscous coupling in such a way that the fan rotational speed essentially corresponds to the drive rotational speed of the drive unit. In this way, it is possible to provide a maximum cooling airflow. This is preferably the case when the controller determines that one of the monitored operating temperatures of the cooling system and/or of the drive unit has reached or exceeded the upper limiting temperature.

In a further advantageous embodiment of the invention, the controller is connected to the drive unit, in order to register a nominal rotational speed and/or a load factor of the drive unit. This offers the technical advantage that the controller is always informed of the current operating state of the drive unit and can drive the viscous coupling correspondingly.

The controller is preferably formed to register different load factors according to the operating mode of the drive unit. It would thereby be conceivable that the controller would, for example, register a lower load factor when the machine is laying the paving at a constant speed than when it is laying the paving at alternating speeds, during which laying the drive unit would be subject to greater loads. The controller is therefore also able to adjust the fan rotational speed according to the load level of the construction machine.

In a further embodiment of the invention, the controller comprises means to calculate an average value of the registered operating temperatures of the cooling system and/or of the drive unit. It would also be advantageous if the means were formed to calculate averaged values of the registered nominal rotational speed and/or of the registered load factor. The averaged values prevent extreme, short-term measured operating values from entering into the automatic regulation of the viscous coupling.

The controller is preferably formed to register a target fan rotational speed. The target fan rotational speed can be produced by the controller and is based on the registered operating temperatures of the cooling system and/or of the drive unit. The target fan rotational speed is preferably also based on the nominal rotational speed and/or the load factor of the drive unit, in addition to on the registered operating temperatures. It is likewise conceivable that all or a certain collection of registered operating temperatures of the cooling system can be combined in any way with a certain selection of temperatures or parameters typical for the drive in order to determine the target fan rotational speed. As a result, the controller allows complex operating conditions to be taken into consideration in a target quantity, namely the target fan rotational speed, in order to undertake effective driving of the viscous coupling.

In a further advantageous embodiment of the invention, the controller comprises a control unit that is connected to the viscous coupling and that, by means of the registered target fan rotational speed, generates an actuating variable by means of which the viscous coupling can be driven. In particular, the actuating variable controls the oil level in the viscous coupling in order to achieve a required target fan rotational speed. It is advantageous that the control unit makes possible a low-noise change to the target fan rotational speed.

In a further embodiment, the controller comprises memory from which the stored data for generating the target fan rotational speed can be retrieved. The stored data preferably comprise an averaged load factor registered by the controller, as well as an averaged ambient temperature of the drive unit registered by the controller. It is advantageous if the stored data can be converted directly into the target fan rotational speed by means of the use of a mapping that is provided for the controller. The memory improves the response time to a possible overheating of the construction machine, because the data for determining the target fan rotational speed, particularly the averaged load factor and the averaged ambient temperature of the drive unit, can be retrieved immediately from memory in the event that the controller has registered a critical operating temperature of the cooling system and/or of the drive unit.

A maximum target fan rotational speed can be fed to the control unit for creating the actuating variable if the controller registers that one of the operating temperatures of the cooling system and/or of the drive unit has reached or exceeded an upper limiting temperature. This allows maximum cooling capacity, in order for the affected operating temperature to be returned below the limiting temperature. It is likewise possible that the controller provides a minimum target fan rotational speed of the control unit for creating the actuating variable if the controller registers that the drive unit is idling. In this way, the fan can be spared and the use of unnecessary fuel can be prevented.

The viscous coupling preferably comprises a sensor that registers an actual fan rotational speed. In a further embodiment, the control unit is formed to form the actuating variable based on a difference between the actual fan rotational speed and the target fan rotational speed, whereby the viscous coupling can be driven with this actuating variable. The sensor can be a filling level sensor for registering the oil level in the viscous coupling, whereby it is possible to determine the actual fan rotational speed by means of the oil level and the current drive rotational speed of the drive unit. The sensor can just as well be a motion sensor that is formed to determine the actual fan rotational speed directly. The sensor can be built into the viscous coupling economically.

The invention furthermore relates to a method for the automatic regulation and control of a cooling system of a construction machine by means of a viscous coupling. The viscous coupling is thereby connected on the input side to a drive unit and on the output side to a fan of the cooling system, whereby, according to the invention, the viscous coupling is regulated depending on different operating parameters in such a way that a certain fan rotational speed is established on the output side of the viscous coupling.

The technical advantages of the invention mentioned at the beginning also apply in the case of the used method.

BRIEF DESCRIPTION OF THE DRAWINGS

Embodiments of the object of the invention are explained on the basis of the following drawings.

Shown are:

FIG. 1 shows a construction machine 1 according to the invention with a cooling system 2 and a drive unit 3. The cooling system 2 comprises a viscous coupling 4 that is connected on the output side to a fan 5. The fan 5 is provided for generating a cooling airflow that cools cooling media such as charge air, cooling water and hydraulic oil.

Figure 1:
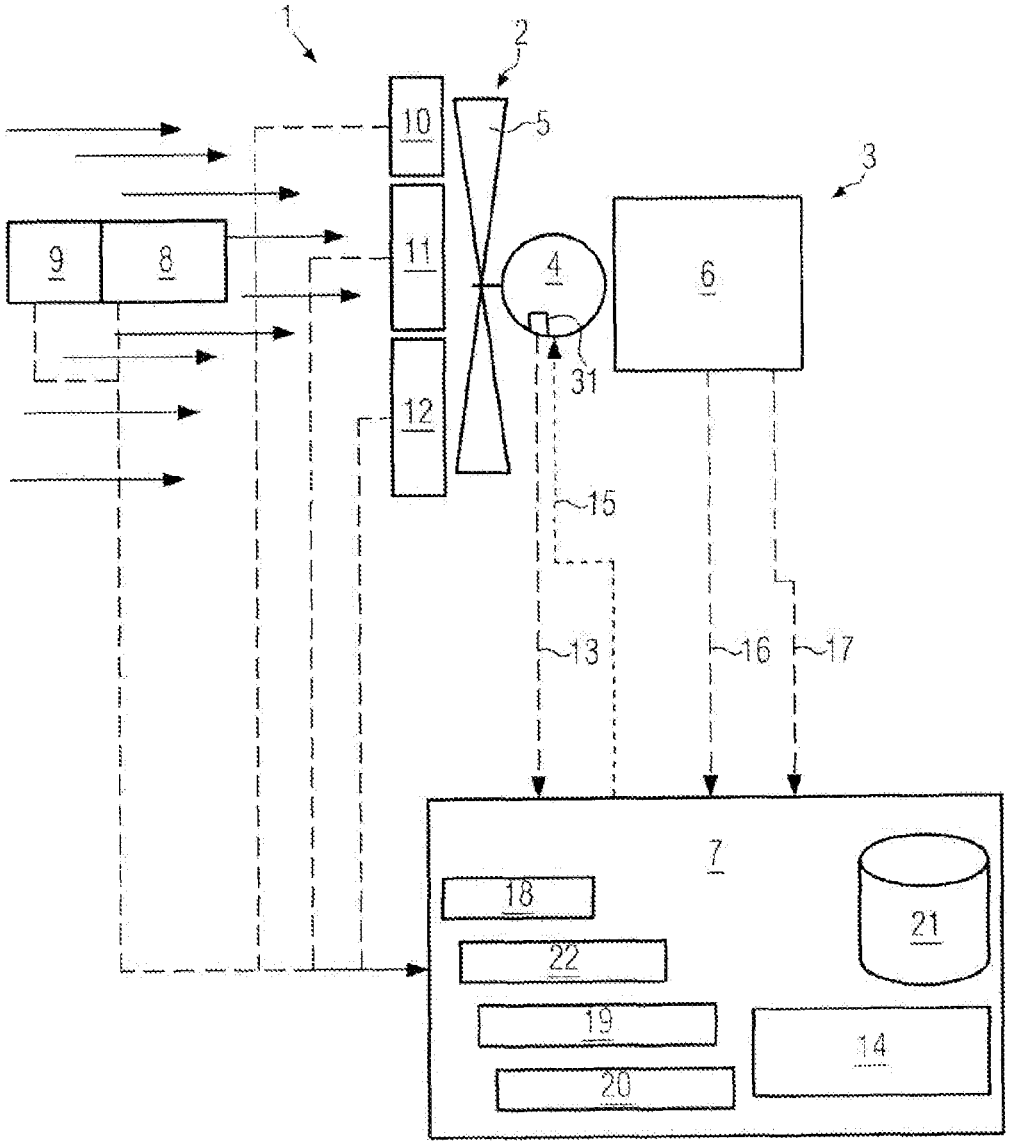
FIG. 1 a schematic representation of the automatic fan rotational speed regulation according to the invention for a construction machine, FIG. 2 a detailed depiction of the controller, FIG. 3 a diagram which depicts the method according to the invention for automatic fan rotational speed regulation, and FIG. 4 a target fan rotational speed curve depending on the nominal rotational speed of the drive unit.

The viscous coupling 4 is connected on the input side to a motor 6 of the drive unit 3. The cooling system 2 furthermore comprises a controller 7, which is provided for registering an ambient temperature 8 and/or an intake temperature 9 of the drive unit 3. The controller 7 is optionally provided for registering the temperature of the media to be cooled, meaning a charge air temperature 10, a cooling water temperature 11 and/or a hydraulic temperature 12.

As shown by FIG. 1, the fan 5 can be driven with the help of the viscous coupling 4 attached to the motor 6, instead of rigidly or with a hydraulic motor. An actual fan rotational speed 13 can be registered by a sensor 31, which is integrated into the viscous coupling 4. The actual fan rotational speed 13 can be transmitted from the viscous coupling 4 to the controller 7.

A further element of the controller 7 is a control unit 14. The control unit 14 is provided in order to send an actuating variable 15 to the viscous coupling 4.

FIG. 1 likewise shows that the controller 7 is connected to the motor 6 of the drive unit 3, and is formed to register a nominal rotational speed 16 and/or a load factor 17 of the motor 6 of the drive unit 3. The controller 7 is able to generate the actuating variable 15 by means of the registered signals 8, 9, 10, 11, 12, 13, 16, 17 or at least by means of a certain selection of these.

The controller 7 likewise comprises a mapping 18, which is provided for determining a target fan rotational speed by means of the registered load factor and the registered ambient temperature 8 or the intake temperature 9. The controller 7 furthermore comprises means 19 that are provided for forming the average of the registered signals 8, 9, 10, 11, 12, 13, 16, 17. The controller 7 is hereby formed to register a plurality of values of each measurement quantity with the number 2 to 1,000 as well as with a sampling rate of 10 msec to 360 sec. An average value can be derived from these values at a fixed sampling rate in the range of 10 msec to 360 sec. A registering of 20 values preferably takes place at a sampling rate of 1 sec. It is likewise conceivable that an alternative averaging can be carried out by a moving average, geometric average, harmonic average, square average or by a cubic average.

In order to prevent audible noise differences from arising when there are changes in the specified fan rotational speed, the controller 7 comprises a ramp function 20 in order to attenuate rotational speed jumps on the fan. If there is a new target rotational speed value for the fan 5, this can be reached by a step-by-step adjustment of the target fan rotational speed at a previously defined gradient. In order to prevent the operator from obtaining the impression of a rotational speed jump, the gradient of the ramp function is formed so as to be essentially flat. On the other hand, it is provided that the gradient of the ramp function 20 is not too flat, in order to prevent overheating of the cooling system 2. The gradient of the ramp function 20 is preferably adjusted in a range between 0.1 revolutions/sec and 200 revolutions/sec. It is advantageous if the gradient of the ramp function lies at 12 rotations/sec.

The controller 7 furthermore comprises memory 21 that is formed to store the input quantities of the controller 7, namely the ambient temperature 8, the intake temperature 9, the charge air temperature 10, the cooling water temperature 11, the hydraulic oil temperature 12, the actual fan rotational speed 13, the diesel engine nominal rotational speed 16 and/or the load factor 17. In particular, the averaged values of the ambient temperature 8 and averaged values of the load factor 17 can be stored in the memory 21 in order to be retrieved by the controller 7 as needed. The memory 21 is optionally provided for temporary storage of the input signals.

Figure 2:
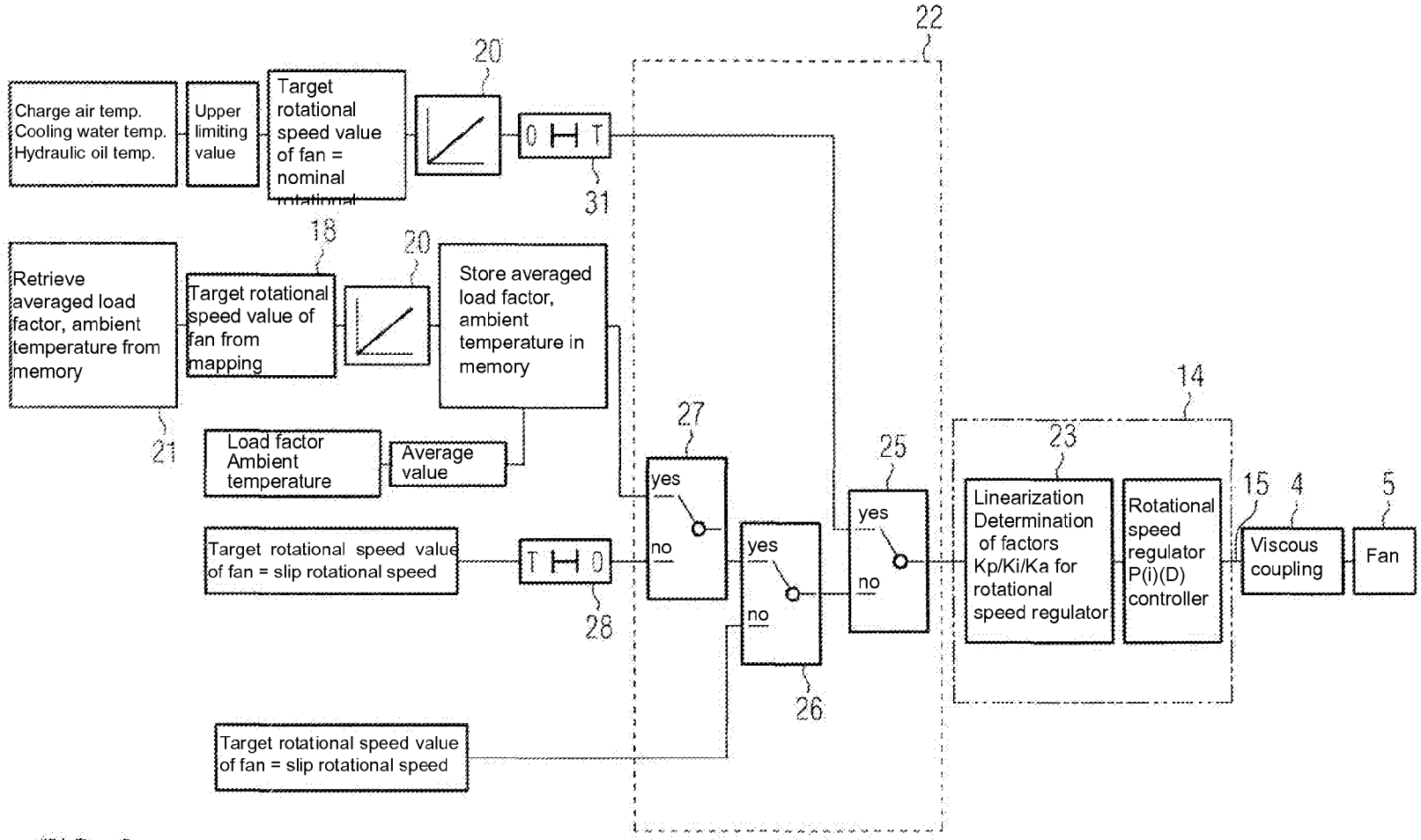

FIG. 2 shows the functioning of the controller 7. The controller 7 comprises evaluation logic 22 that is arranged on the input side of the control unit 14. The evaluation logic 22 is provided for changing the fan rotational speed without the operator noticing it, if possible. The control behaviour of the viscous coupling 4 can be coordinated to the rotational speed behaviour of the construction machine 1 by the evaluation logic 22. To generate the actuating variable 15, the control unit 14 is equipped with linearization 23 and with a downstream P-controller 24 that can optionally be executed as a PI or PID controller. The linearization 23 stipulates the control factors Kp, Ki or Ka, that are constant or changeable depending on the input quantities, such as, for example, the actual fan rotational speed 13 and the nominal rotational speed 16. The control factors are preferably adjusted to the operating points of the viscous coupling 4 by means of specified characteristic curves.

In order to prevent overheating of the cooling system 2, the evaluation logic 22 comprises a first logic member 25, which is formed to monitor whether or not the temperatures 10, 11, 12 of the cooling system 2 have reached or exceeded an upper limiting value. If the upper limiting temperature has been reached or exceeded, the first logic member 25 of the control unit 14 transmits a target fan rotational speed which corresponds to the registered nominal rotational speed of the motor 6 of the drive unit 3. In order to prevent the control unit 14 from reacting in a frantic manner, the target fan rotational speed is attenuated by the ramp function 20. In the event that an overheated machine is detected, the controller 7 is formed to maintain the maximum fan rotational speed for a certain time, even if the actual temperature falls below the limiting temperature, by means of an optional stopping time 31. The first logic member 25 is furthermore alternatively (not shown) formed to check the operating temperatures of the cooling system 2 with respect to whether or not the actual temperature has reached or fallen below a lower limiting temperature. If this is the case, the first logic member 25 passes a target fan rotational speed to the control unit 14, whereby this target fan rotational speed corresponds to a slip rotational speed of the drive unit 3.

FIG. 2 furthermore shows that the evaluation logic 22 comprises a second logic member 26. The second logic member 26 is formed to recognize the nominal rotational speed 16 of the drive unit 3 or to register whether or not there has been a change in the nominal rotational speed. If the controller 7 registers the nominal rotational speed 16 of the drive unit 3, a further, third logic member 27 of the evaluation logic 22 checks whether or not an optional start delay 28 has expired.

The start delay 28 is switched to active when there is a change in the nominal rotational speed 16 of the drive unit 3, so that for a particular time interval, namely the start delay 28, first the slip rotational speed is routed to the control unit 14 as the target fan rotational speed. If the start delay 28 has expired, the first, the second and the third logic members 25, 26, 27 are switched in such a way that a connection is made between the control unit 14 and the memory 21, so that the averaged values can be retrieved from the memory 21 in order to determine a specific target fan rotational speed. The target fan rotational speed can be determined from the mapping 18 by means of a comparison of the averaged and stored values of the load factor 17 and the ambient temperature 8. The determined target fan rotational speed can be passed on to the control unit 14 by the ramp function 20 in an attenuated way, so that the control unit 14 does not react in a frantic manner.

At the same time, the current load factor 17 and the current ambient temperature 8 are stored in the memory 21 so that these values are available in the event of a subsequent change in the nominal rotational speed of the construction machine 1. Storage of the averaged values is likewise possible.

Figure 3A:
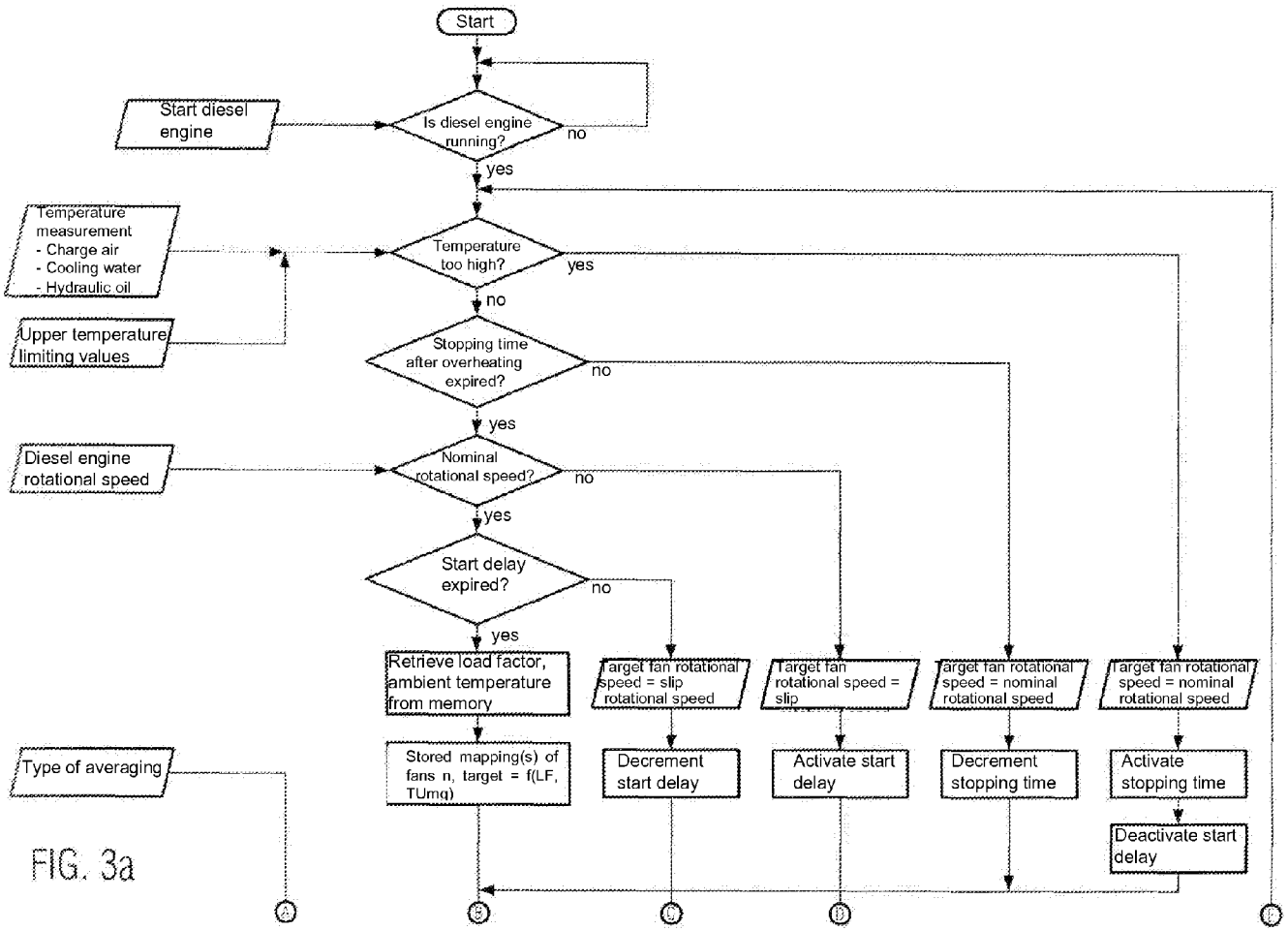
Figure 3B:
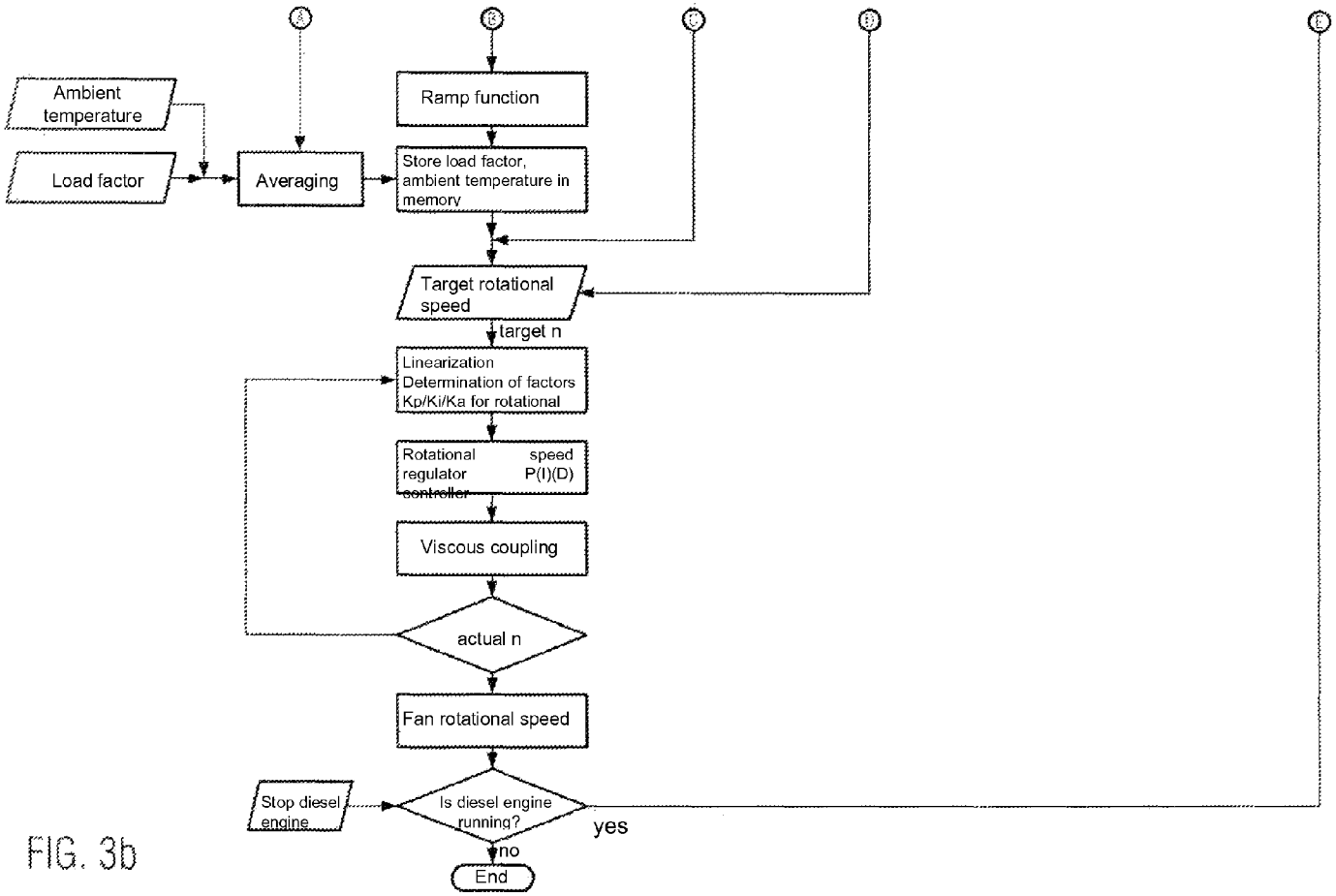

FIG. 3 shows a diagram of the method for fan rotational speed regulation. First a check is made to see whether or not the motor 6 of the drive unit 3 is operating. If it is, the controller checks whether or not one of the operating temperatures 10, 11, 12 of the cooling system 2 has reached or exceeded an upper limiting temperature. If this is the case, the controller 7 sets the fan rotational speed equal to the nominal rotational speed of the motor 6. The stopping time is simultaneously activated and the start delay 28 is deactivated. In order to prevent the set target fan rotational speed from bringing about a frantic reaction of the control unit 14, the target fan rotational speed is first attenuated with the ramp function 20. The current load factor 17 and ambient temperature 8 and/or intake temperature 9 are separately stored in memory 21 after an optional averaging 19 so that the current state of the drive unit is available to the controller 7 in the event that the particular temperatures no longer correspond to the limiting temperatures. The attenuated target fan rotational speed value is passed to the viscous coupling 4 as the actuating variable 15. The oil level of the viscous coupling 4 is consequently regulated in such a way that the required target fan rotational speed is set up in the fan 5.

Alternatively, if the motor 6 has been switched on, the controller 7 can determine that none of the operating temperatures 10, 11, 12 of the cooling system 2 have reached an upper limiting temperature.

After a case of overheating, if the temperature measurement just no longer determines overheating, the target fan rotational speed is left at the nominal rotational speed for a stopping time. If the controller 7 does not determine that one of the operating temperatures has reached the upper limiting temperature and the stopping time has expired after overheating, which means that the operating temperatures of the cooling system 2 are below the limiting temperatures and the time of the stopping phase has elapsed, then the operating situation of the motor 6 is checked. If this is not at the nominal rotational speed, the target fan rotational speed is set equal to the slip rotational speed of the viscous coupling. After activating the start delay 28, the actuating variable for the viscous coupling is generated from the target rotational speed in the control unit 14. The viscous coupling is regulated in such a way that the slip rotational speed is adjusted in the fan.

On the other hand, if the nominal rotational speed is on the drive system 3, a query is made regarding the expiration of the start delay 28. As long as the start delay 28 is active, it is counted down and the slip rotational speed is transmitted as the target value to the target rotational speed value with the following control unit 14. On the other hand, if the condition regarding the expired start delay 28 applies, a target fan rotational speed value is generated with the help of stored values of the load factor 17 and ambient temperature 8 from the stored mapping 18 and attenuated with the ramp function 20. Following this, the current state of the drive unit is stored in memory 21, so that these values are available to the controller for a renewed generation of the target fan rotational speed from the mapping 18. The target rotational speed value generated from the mapping is passed to the control unit 14 so that the target rotational speed is established on the fan.

Figure 4:
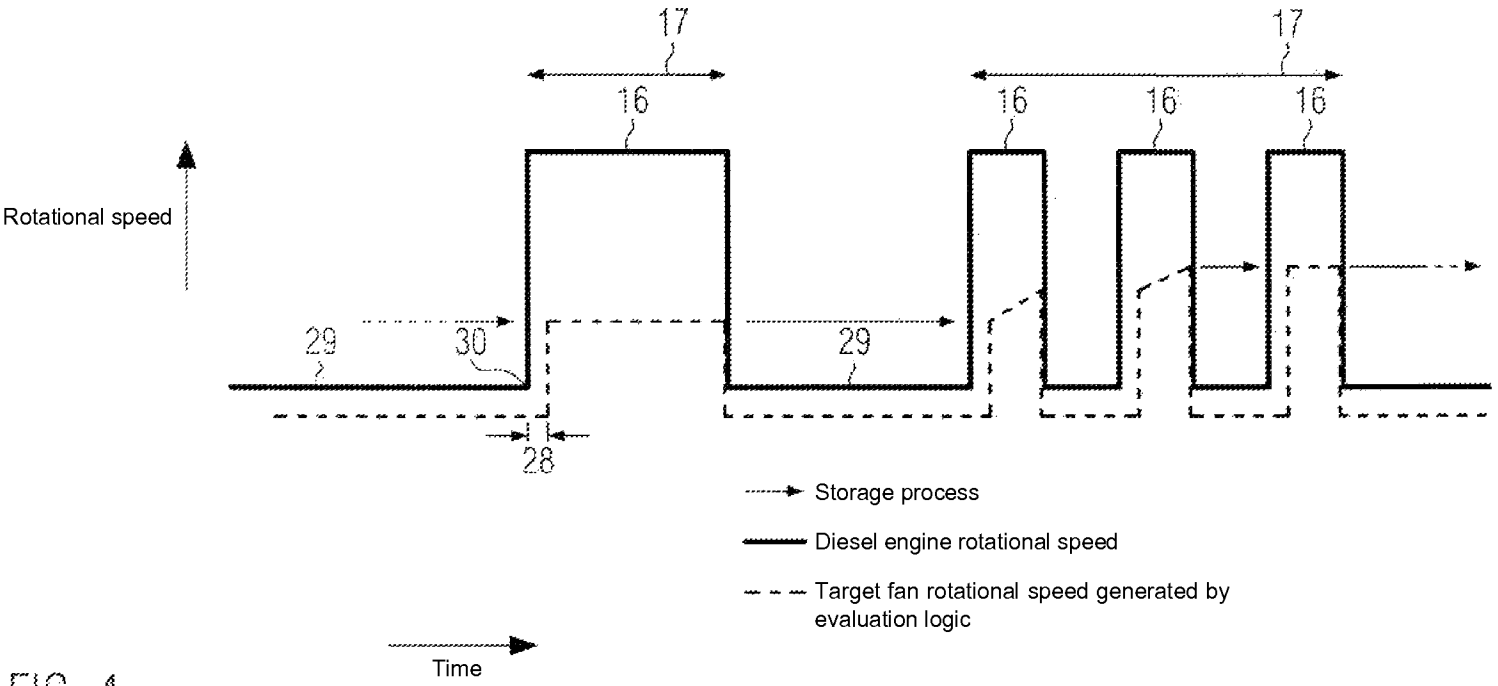

FIG. 4 depicts a typical rotational speed curve for a construction machine 1 according to the invention. There is thereby a change between idling phases 29, in which the construction machine 1 is stopped, and laying and transport phases, in which the motor 6 of the drive unit 3 is operated at the nominal rotational speed 16. Depending on the nominal rotational speed 16 of the motor 6 and consequently on the input rotational speed at the viscous coupling 4, there is an adjustment of the logic members 25, 26, 27 present in the evaluation logic 22 in order to transmit to the control unit 14 a target fan rotational speed adjusted for the operating situation of the construction machine. In the event of a low input rotational speed at the viscous coupling 4, the viscous coupling 4 can be only slightly regulated to a predetermined target fan rotational speed. It is consequently the case, particularly during idling phases, that the target fan rotational speed is reduced to the slip rotational speed, meaning the minimum possible rotational speed of the viscous coupling. It is intentionally possible to do without a fan rotational speed specification during idling phases. The advantage of this is that the viscous coupling 4 is completely decoupled and the fan is not accelerated whenever there are jumps in the rotational speed, because there is only a little quantity of oil in the viscous coupling during the acceleration procedure.

If there is a rotational speed jump 30 to a nominal rotational speed 16 of the drive unit 3 during idling 29, meaning when the construction machine changes from idling to paving, after the register of the nominal rotational speed 16 first a start delay 28 may expire before the target fan rotational speed is specified by the controller 7. The start delay 28, after which the control unit 14 receives the target fan rotational speed and generates from it the actuating variable 15, is determined by the overshooting behaviour of the viscous coupling 4 and can lie in the range from 0.1 to 10 seconds. The start delay 28 preferably runs for 3 seconds.

When the rotational speed jump 30 takes place, the last active load state and the last ambient temperature 8 can be retrieved from the memory 21 and can be converted into the target fan rotational speed by the use of the mapping 18. Then average values are formed from the current load factor 17 and the current ambient temperature 8 from recorded measured values at a preset sampling rate. These average values are stored in the memory 21 and are available for the proximate cycle, in which there is a renewed rotational speed specification.

This automatic target fan rotational speed regulation is based on the assumption that the average load of the drive unit 3 changes only negligibly during a laying process. In the event of a renewed change from pavement-laying operation into idling, the target fan rotational speed is set equal to the slip rotational speed. The last load state and the last ambient temperature at the nominal rotational speed 16 thereby remain available in the memory 21.

If the load level of the motor 6, which means the load factor 17, changes on the other hand, the cooling airflow is consequently adjusted. In order to avoid larger rotational speed jumps in the fan 5, the target fan rotational speed determined by means of the mapping 18 is stipulated with a previously defined gradient by the ramp 20. The target fan rotational speed determined in this way is used as the input for the control unit 14 of the viscous coupling 4. The fan rotational speed specification resulting in this way is shown in dashed lines in FIG. 4.

Construction machines, such as road pavers or feeders, require the maximum cooling air volume flow only in the event of extreme working conditions at very high ambient temperatures, as well as in the event of very high motor loads. This operating state occurs infrequently, however, so that the fan rotational speed can be reduced for a multiplicity of application cases, consequently leading to a lower noise level on the construction machine. If the fan is not operated at the maximum design point, it is possible to save fuel due to the reduced fan rotational speed. Compared to a hydraulically driven fan, the viscous coupling has lower losses during the reduction of the rotational speed of the fan, so that the system with a viscous coupling has a better overall degree of efficiency. Until now, no regulated viscous coupling was used in road pavers due to the rotational speed profile. A great advantage of a regulated fan rotational speed lies in the time to respond to possible overheating of the machine. Because the load factor and the ambient temperature at the time of the heating-up process of the cooling media have already been stored, the fan rotational speed can be set up before a temperature rise in the cooler. As a result, down times in the motor-cooler-fan system are bypassed, because the correct airflow can be adjusted by the cooler before a possible overheating.

The invention claimed is:

1. Construction machine having automatic fan rotational speed regulation, comprising a drive unit and a cooling system with a fan in order to generate a cooling airflow, wherein the cooling system further comprises an adjustable viscous coupling that is connected on the input side to the drive unit and on the output side to the fan, wherein the cooling system comprises a controller connected to the viscous coupling, and to the drive unit to register a rotational speed of the drive unit, the controller comprises a mapping for determining a target fan rotational speed, a means for calculating an average value of the registered rotational speed of the drive unit and further comprises a memory for storing at least load factors of the drive unit and ambient temperatures of the drive unit, wherein the controller is configured to (i) register a load factor and ambient temperatures of the drive unit and includes means for calculating an average value of the registered load factors and the registered ambient temperatures, (ii) determine a target fan rotational speed based on the average value of the registered load factors and the average value of the registered ambient temperatures of the drive unit, and (iii) determine the target fan rotational speed by means of the mapping based on averaged stored load factors and averaged stored ambient temperatures from the memory, and wherein the target fan rotational speed is at a minimum when the controller registers that the drive unit is idling and wherein if there is a rotational speed jump of the drive unit during idling a start delay is set to delay calculation of the target fan rotational speed by the controller.

2. Construction machine according to claim 1 wherein the controller registers at least one operating temperature of the cooling system.

3. Construction machine according to claim 2 wherein the at least one operating temperature of the cooling system is a temperature of the charge air, hydraulic oil or cooling water.

4. Construction machine according to claim 3 wherein the controller is configured to register at least one operating temperature of the drive unit.

5. Construction machine according to claim 4 wherein the controller comprises a control unit that is connected to the viscous coupling and that generates an actuating variable by means of the target fan rotational speed, wherein the viscous coupling can be driven by means of this actuating variable.

6. Construction machine according to claim 4 wherein the controller comprises memory from which stored data can be retrieved for generating the target fan rotational speed.

7. Construction machine according to claim 4 wherein the target fan rotational speed is at a maximum when the controller registers that one of the operating temperatures has reached an upper limiting temperature.

8. Construction machine according to claim 4 wherein the target fan rotational speed is at a minimum when the controller registers that one of the operating temperatures has reached a lower limiting value.

9. Construction machine according to claim 1 wherein the viscous coupling comprises a sensor that registers an actual fan rotational speed.

10. Construction machine according to claim 1 wherein the controller comprises a means for calculating an average value of the registered operating temperatures of the cooling system.

11. Construction machine according to claim 1 wherein the controller is configured to register at least one operating temperature of the drive unit.

12. Method for the automatic regulation and control of a cooling system of a construction machine by means of an adjustable viscous coupling connected on the input side to a drive unit and on the output side to a fan of the cooling system which comprises regulating the viscous coupling depending on different operating parameters so that a certain fan rotational speed is set up at the viscous coupling on the output side, configuring a controller of the cooling system that is connected to the viscous coupling and to the drive unit to register a load factor, a rotational speed of the drive unit and ambient temperatures of the drive unit and the controller including means for calculating an average value of the registered load factors and the registered ambient temperatures, configuring the controller to store an average value of registered load factors and an average value of registered ambient temperatures on a memory of the controller, and further configuring the controller to determine a target fan rotational speed based on the average value of the stored registered load factors and the average value of the stored registered ambient temperatures of the construction machine using a mapping of the controller and wherein the target fan rotational speed is at a minimum when the controller registers that the drive unit is idling and wherein if there is a rotational speed jump of the drive unit during idling a start delay is set to delay calculation of the target fan rotational speed by the controller.

* * * * *